US011503976B2

(12) United States Patent
Stone

(10) Patent No.: US 11,503,976 B2
(45) Date of Patent: Nov. 22, 2022

(54) CLEANING APPARATUS

(71) Applicant: Brenda Stone, Los Angeles, CA (US)

(72) Inventor: Brenda Stone, Los Angeles, CA (US)

( * ) Notice: Subject to any disclaimer, the term of this patent is extended or adjusted under 35 U.S.C. 154(b) by 91 days.

(21) Appl. No.: 17/011,992

(22) Filed: Sep. 3, 2020

(65) Prior Publication Data

US 2021/0068607 A1 Mar. 11, 2021

Related U.S. Application Data

(60) Provisional application No. 62/896,977, filed on Sep. 6, 2019.

(51) Int. Cl.
*A47L 13/16* (2006.01)
*A47L 13/44* (2006.01)

(52) U.S. Cl.
CPC ..... *A47L 13/16* (2013.01); *A47L 13/44* (2013.01)

(58) Field of Classification Search
CPC ..... A47L 13/16; A47L 13/44; A47L 13/10; A47L 13/20; A47L 13/50; A47L 11/00; A47L 11/29; A47L 11/4041; B08B 1/00; C09K 3/32
USPC ..... 15/210.1
See application file for complete search history.

(56) References Cited

U.S. PATENT DOCUMENTS 4,385,408 A 5/1983 Rhodes
4,878,257 A 11/1989 Hardin
6,223,362 B1 5/2001 Liang
6,564,398 B1 5/2003 Trott
9,179,804 B2 11/2015 May
2005/0241093 A1* 11/2005 McKenzie ..... A47L 13/16 15/209.1
2006/0059619 A1 3/2006 Kim
2006/0179596 A1* 8/2006 Sharratt ..... B08B 1/00 15/230.11
2018/0168405 A1* 6/2018 Mason ..... A47K 1/09
2018/0199787 A1* 7/2018 Li ..... A47L 13/144
2020/0359776 A1* 11/2020 Gallego ..... A46B 13/001

OTHER PUBLICATIONS

"Hand Rest Cushion,Soft Detachable Nail Art Hand Pillow,Manicure Tool Washable Hand Holder Cushion", https://www.amazon.com/Cushion-Detachable-Pillow-Manicure-Washable/dp/B085495YCY.

* cited by examiner

*Primary Examiner* — Orlando E Aviles
*Assistant Examiner* — Jacob Adam Montgomery

(57) ABSTRACT

A cleaning apparatus includes an elongated body, a pair of end caps, a filling member, an internal compartment, and an opening. The elongated body includes a first end a second end. The pair of end caps includes a first end cap and a second end cap. The internal compartment traverses through the elongated body. The internal compartment is extended from the first end to the second end. The filling member is positioned within the internal compartment. The first end cap is terminally connected around the first end. The second end cap is terminally connected around the second end. The opening traverses into the internal compartment through the elongated body.

5 Claims, 13 Drawing Sheets

CLEANING APPARATUS

CROSS-REFERENCE TO RELATED APPLICATIONS

This application claims priority to U.S. Provisional Application No. 62/896,977 filed Sep. 6, 2019, which is hereby incorporated herein by reference.

FIELD OF THE INVENTION

The present invention relates generally to cleaning tools. More specifically, the present invention is a cleaning apparatus for cleaning surfaces such as floors. The present invention is specifically designed for cleaning spills of water from a bathtub or a sink. However, the present invention is not limited to this option, and it may further be adapted for different purposes.

BACKGROUND OF THE INVENTION

Water often spills in a household whether from a tub, a shower, or even in the kitchen. Water spills need to be cleaned promptly before they become difficult to clean. However, it may be a hassle to clean up the mess. An option to do so would be to use paper towels, but it would be a waste to throw away paper towels and add to the vast amounts of debris already in landfills. Another option would be to use a bath towel, but the towel would become dirty and the user would not wish to use it to clean their body. Moreover, the existing cleaning tools require a user to bend over to clean the floor, which may cause back pain and fatigue to some users.

Therefore, it is an objective of the present invention to provide a cleaning apparatus which overcomes the problems set forth above. The present invention is a simple apparatus that allows a user to collect water spills on the floor in a convenient and easy manner.

SUMMARY OF THE INVENTION

The present invention discloses a cleaning apparatus that comprises an elongated body, a pair of end caps, a filling member, an internal compartment, and an opening. The elongated body comprises a first end a second end. The pair of end caps comprises a first end cap and a second end cap. The internal compartment traverses through the elongated body. The internal compartment is extended from the first end to the second end. The filling member is positioned within the internal compartment. The first end cap is terminally connected around the first end. The second end cap is terminally connected around the second end. The opening traverses into the internal compartment through the elongated body.

One or more of the following features may be included. The elongated body may be a cylindrical body. The elongated body may be made from liquid-absorbing material. A length of the elongated body may be equal to a length of the internal compartment. The opening may be centrally positioned in between the first end cap and the second end cap. The opening may be a rectangular opening. The cleaning apparatus may further comprise a flap and a fastening mechanism. The flap may comprise a top end and a bottom end. The top end of the flap may be hingedly connected onto the elongated body. The bottom end of the flap may be mounted to the elongated body through the fastening mechanism. The flap being centrally aligned over the opening. The fastening mechanism may comprise a first interlocking fastener and a second interlocking fastener. The first interlocking fastener may be connected onto the elongated body, and the second interlocking fastener may be connected onto the flap. The filling member may comprise a first filling sub-member and a second filling sub-member. The first filling sub-member may be positioned adjacent to the first end of the elongated body. The second filling sub-member may be positioned adjacent to the second end of the elongated body.

BRIEF DESCRIPTION OF THE DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the present invention. That is, the dimensions of the components of the present invention, independently and in relation to each other can be different. It should be noted that the drawings are schematic and not necessarily drawn to scale. Some drawings are enlarged or reduced to improve drawing legibility.

DETAIL DESCRIPTIONS OF THE INVENTION

Figure 1:
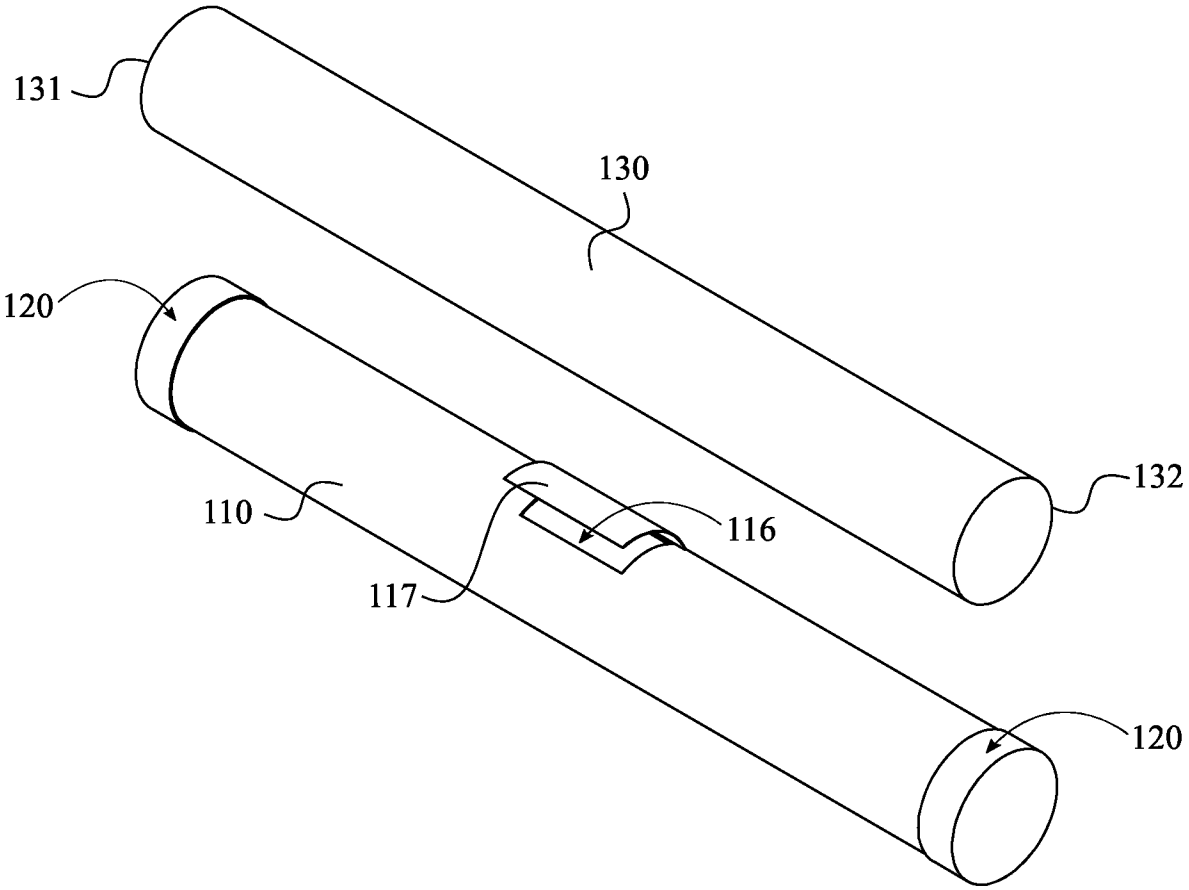
FIG. 1 depicts an exploded view of the present invention.
Figure 2:
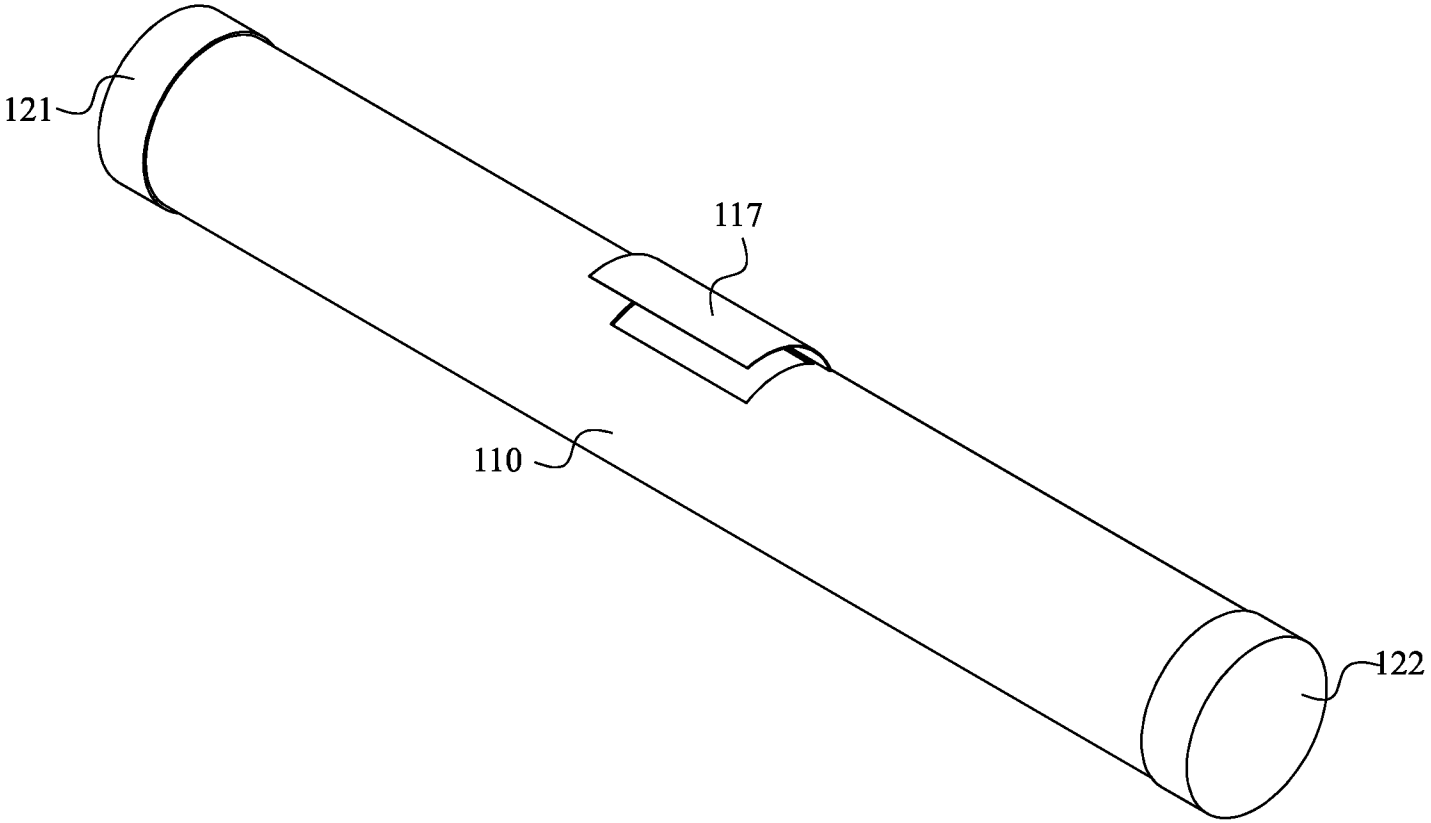
FIG. 2 depicts a perspective view of the present invention, wherein the opening flap is opened.
Figure 3:
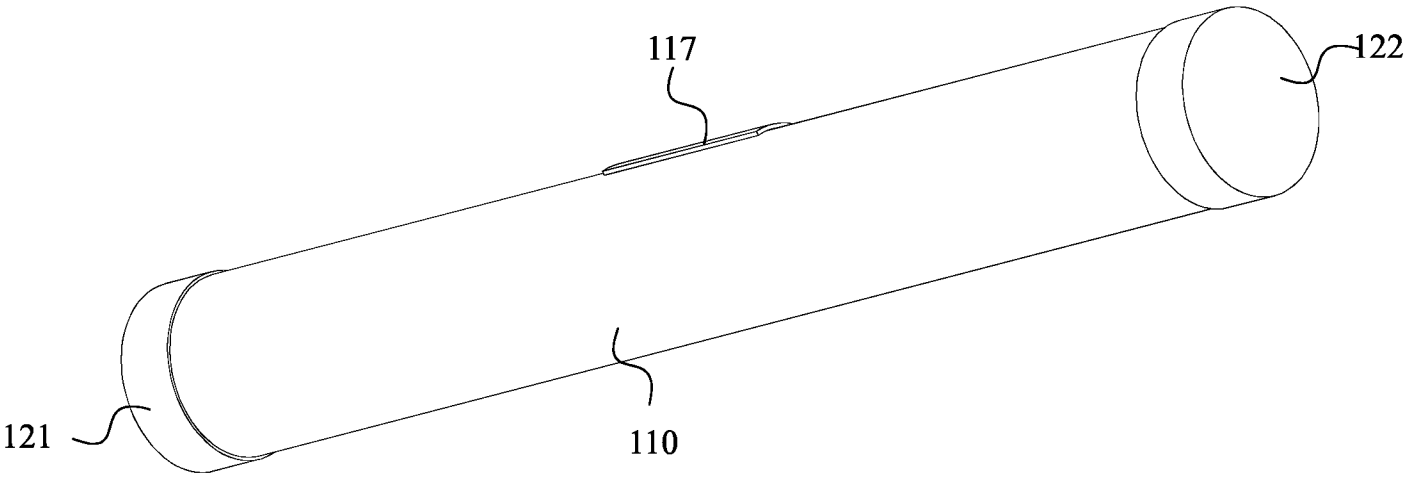
FIG. 3 depicts a perspective view of the present invention, wherein the opening flap is closed.
Figure 4:
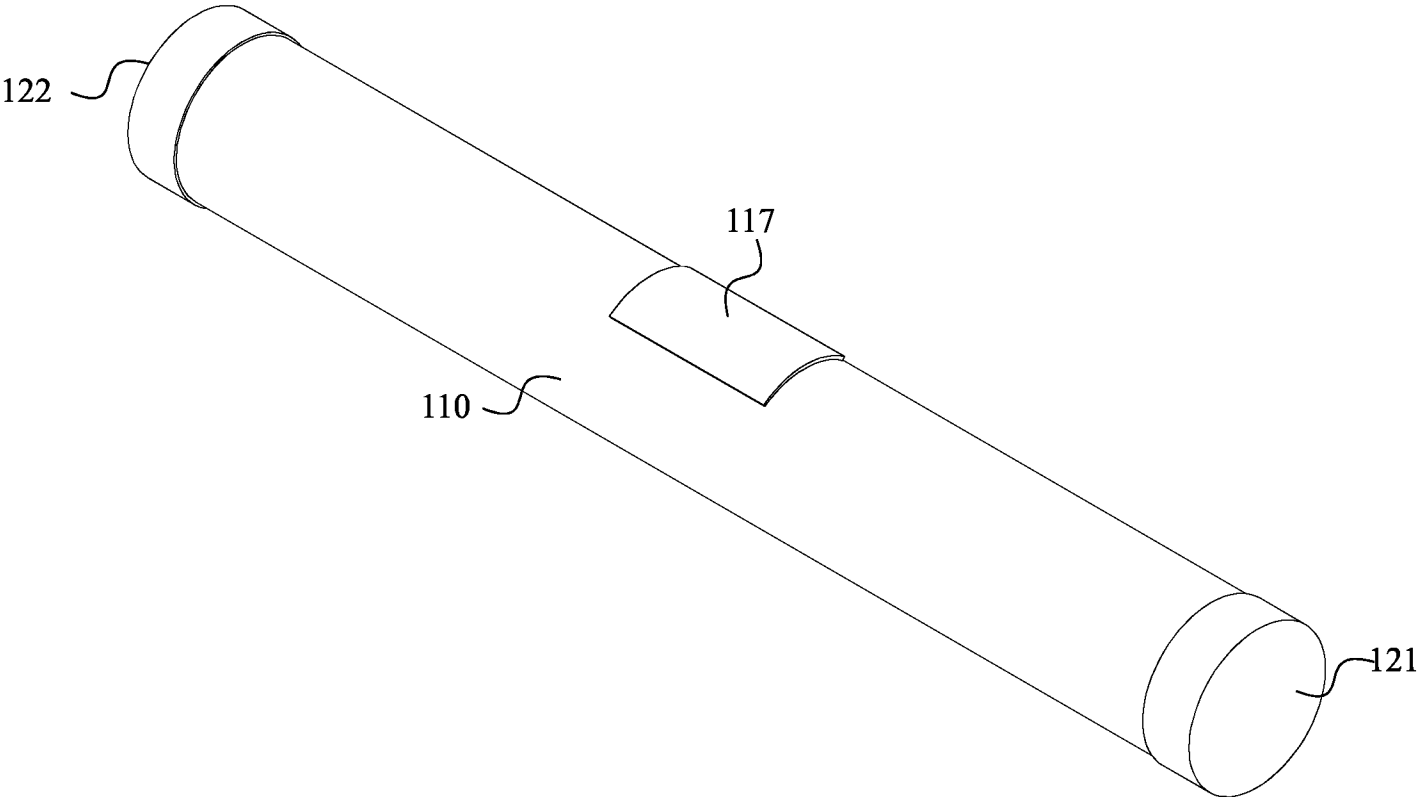
FIG. 4 depicts another perspective view of the present invention, wherein the opening flap is closed.
Figure 5:
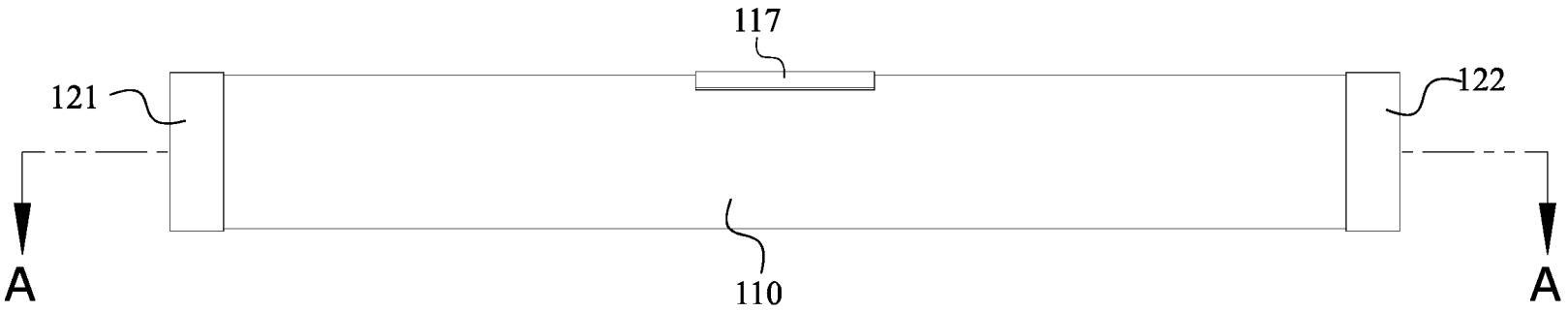
FIG. 5 depicts a front view of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and is made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. When not explicitly defined herein, to the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subject matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate. As used herein, the term "proximate" refers to positions that are situated close/near in relationship to a structure. As used in the following description, the term "distal" refers to positions that are situated away from positions.

The present disclosure includes many aspects and features. Moreover, while many aspects and features relate to, and are described in the context of farrier hoof stands, embodiments of the present disclosure are not limited to use only in this context.

The present invention is a cleaning apparatus that is specifically designed to collect water spills from a bathtub, a sink, etc. It is an aim of the present invention to provide a cleaning apparatus that allows a user to use his/her foot to roll the apparatus on the surfaces (e.g., floors, etc.) to be cleaned. It is another aim of the present invention to provide a cleaning apparatus that is simple in structure, inexpensive to manufacture, and easy to use.

Referring now to the figures of the present disclosure. FIG. 1 is an exploded view illustrating the components of the present invention. The cleaning apparatus of the present invention comprises an elongated body 110, a pair of end caps 120, and a filling member 130.

Figure 6:
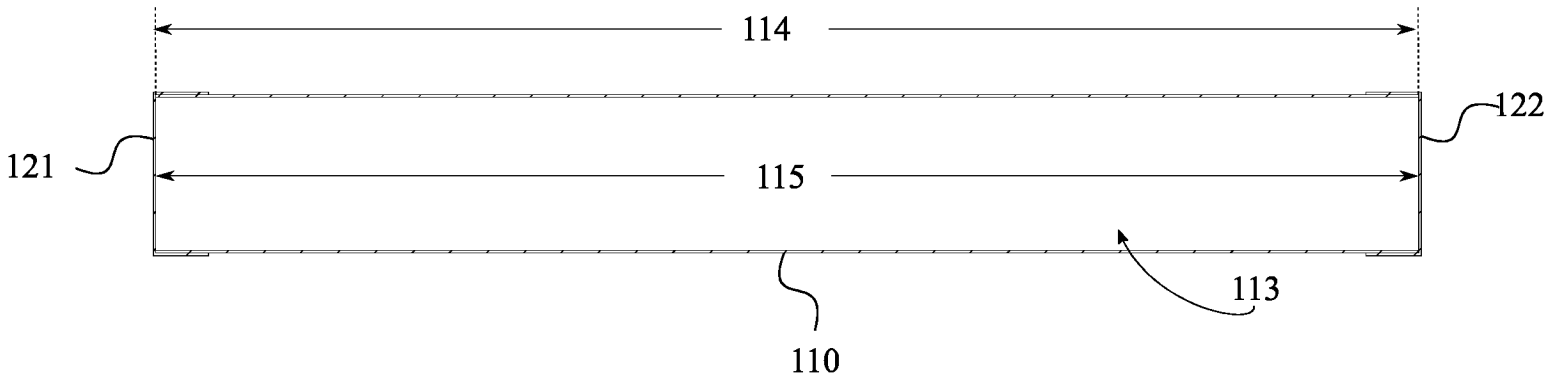
FIG. 6 depicts a cross-sectional view of the present invention, taken along the line A-A in FIG. 5.
Figure 7:
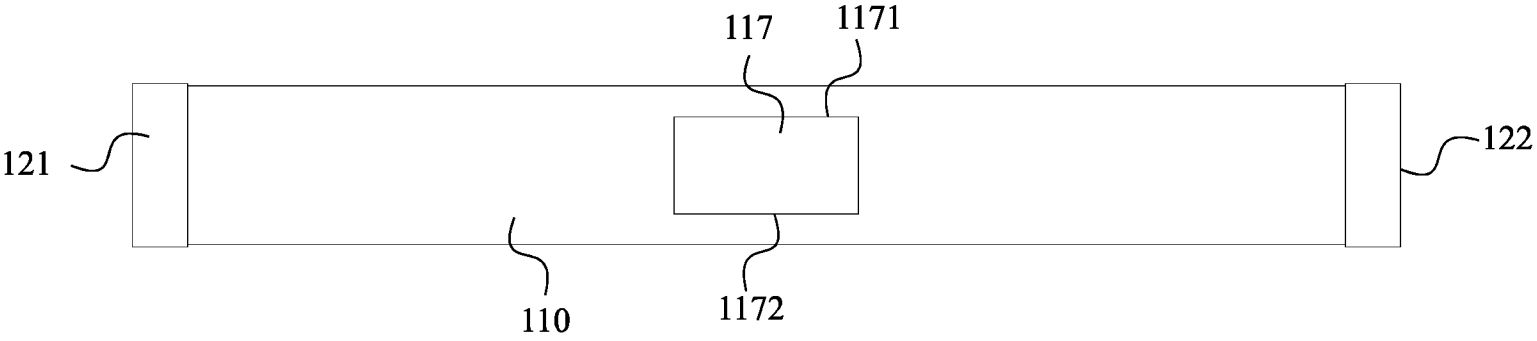
FIG. 7 depicts a top view of the present invention.
Figure 8:
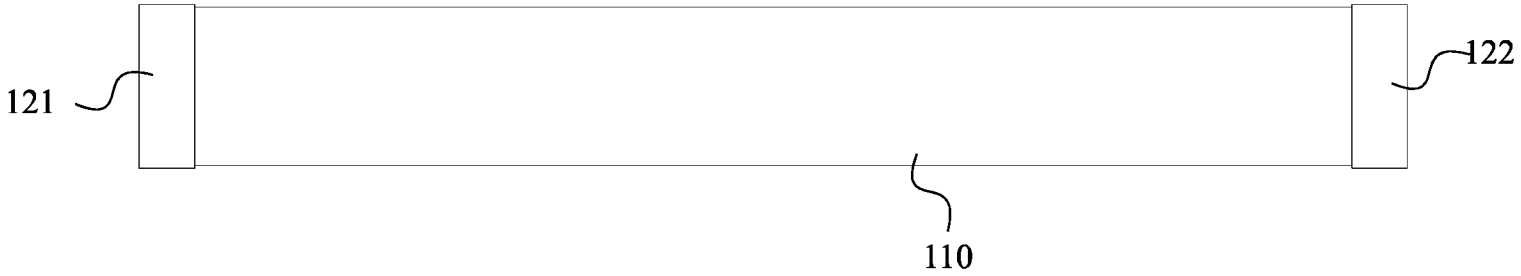
FIG. 8 depicts a bottom view of the present invention.
Figure 9:
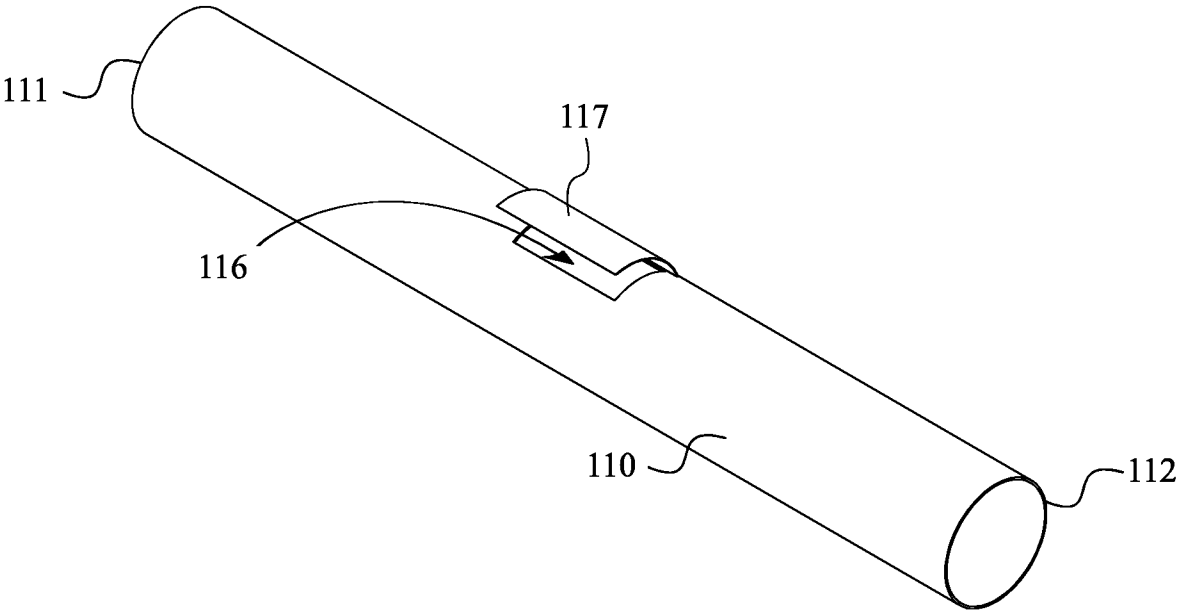
FIG. 9 depicts a perspective view of the elongated hollow body of the present invention.

In reference to FIGS. 1-10, the elongated body 110 is configured to absorb any unwanted excess liquids on the surfaces to be cleaned. It should be noted that the elongated body 110 can be of any shape, size, material, features, type or kind, orientation, location, quantity, components, and arrangements of components that would allow the present invention to fulfill the objectives and intents of the present invention. In a preferred embodiment, the elongated body 110 takes the shape of a circular cylinder, having a first end 111 and a second end 112 that is opposite to the first end 111. The elongated body 110 allows the user to use his/her foot to readily roll the present invention on the floor. The elongated body 110 is preferably hollow and thus defines an internal compartment 113 that traverses through the elongated body 110. Therefore, the internal compartment 113 extends from the first end 111 to the second end 112. Preferably, the internal compartment 113 traverses the entire length of the elongated body 110 for receiving the filling member 130, which is described in more detail hereinafter. Referring to FIG. 6, in this preferred embodiment, a length 114 of the elongated body 110 is equal to a length 115 of the internal compartment 113. Moreover, the first end 111 and the second end 112 of the elongated body 110 are open. The elongated body 110 is preferably made from flexible liquid-absorbing or hydrophilic material, including any suitable non-woven, woven, synthetic, or natural material. Examples of such material include but are not limited to water-absorbing cloth, cellulosic fibers such as wood pulp, water-absorbing gel, super-absorbing polymer, or the like. In another embodiment, the elongated body 110 may be formed by a plurality of layers to absorb more liquids. In one embodiment, various indicia, logos, or graphic images may be applied to the outer surface of the elongated body 110 for personalization of the present invention or for promotional or for advertising purposes.

In an exemplary embodiment, the cylindrical elongated body 110 may be manufactured by rolling a rectangular or square-shaped towel and affixing the free side of the towel body by any suitable methods, including but not limited to sewing, adhesive connection, mechanical fasteners (e.g. snaps, buckles), etc. This prevents the towel from unraveling while also keeping the cylindrical structure.

Figure 10:
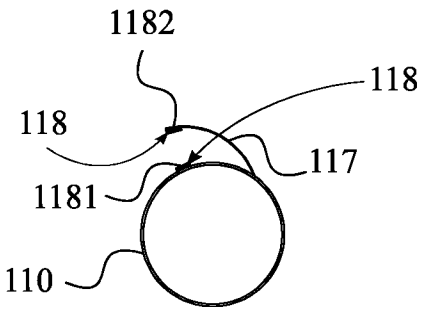
FIG. 10 depicts a right-side view of the elongated hollow body of the present invention.
Figure 11:
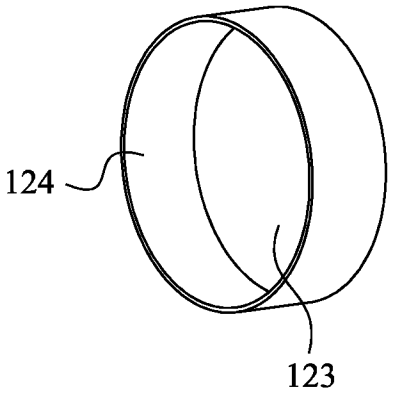
FIG. 11 depicts a perspective view of the end cap of the present invention.
Figure 12:
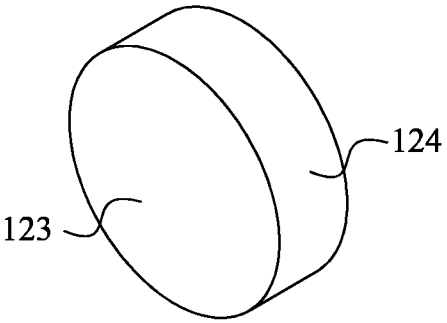
FIG. 12 depicts another perspective view of the end cap of the present invention.

In a preferred embodiment, the elongated body 110 is further provided with an opening 116 that traverse into the internal compartment 113 through the elongated body 110, allowing the user to insert the filling member 130 into or remove it from the internal compartment 113. The opening 116 is preferably of rectangular shape and centrally positioned in between the pair of end caps. However, it should be noted that other shapes and locations are also contemplated and encompassed within the scope of the present invention. The length of the rectangular opening 116 may be parallel to the length 114 of the elongated body 110. In a preferred embodiment, the opening 116 may further comprise a flap 117 that is configured to close the opening 116 when the present invention is in use. The flap 117 may be of the same shape as the opening 116 (i.e., rectangular) and sized to be slightly larger than the opening 116, such that the flap 117 can entirely cover and close the opening 116. The flap 117 may comprise a top end 1171 and a bottom end 1172. The top end of the flap 1171 may be hingedly connected onto the elongated body 110. This hinge mechanism enables the user to lift or lower the flap 117. The bottom end 1172 of the flap 117 may be mounted to the elongated body 110 through a fastening mechanism 118 that keeps the opening 116 closed in use. As shown in FIG. 10, the fastening mechanism 118 may comprise a first interlocking fastener 1181 and a second interlocking fastener 1182. The first interlocking fastener 1181 may be connected onto the elongated body 110, and the second interlocking fastener 1182 may be connected onto the flap 117. The flap 117 is preferably centrally aligned over the opening 116. The fastening mechanism 118 may include but are not limited to hook and loop fasteners, snaps buttons, zippers, sticky pads, etc.

Referring now to FIGS. 1-8, and 11-12, the pair of end caps 120 is configured to enclose the open ends of the cylindrical elongated body 110. It should be noted that the pair of end caps 120 can be of any shape, size, material, features, type or kind, orientation, location, quantity, components, and arrangements of components that would allow the present invention to fulfill the objectives and intents of the present invention. In the illustrated embodiment, the pair of end caps 120 comprises a first end cap 121 and a second end cap 122. The first end cap 121 and the second end cap 122 are designed to have a cross-section conforming to the first end 111 and the second end 112 of the cylindrical elongated body 110, respectively. In a preferred embodiment, the first end cap 121 is identical to the second end cap 122. The first end cap 121 or the second end cap 122 may comprise a circular base plate 123 that is slightly larger than the cross-section of the elongated body 110, and an annular sidewall 124 that extends perpendicularly from the circumference of the circular base plate 123. In this way, a cavity is formed in the first end cap 121 or the second end cap 122 to receive the first end 111 or the second end 112 of the elongated body 110. The first end cap 121 or the second end cap 122 may be connected to the first end 111 or second end 112 of the cylindrical elongated body 110 by any suitable methods, including but not limited to sewing, adhesive connection, or other suitable permanent connection.

Figure 13:
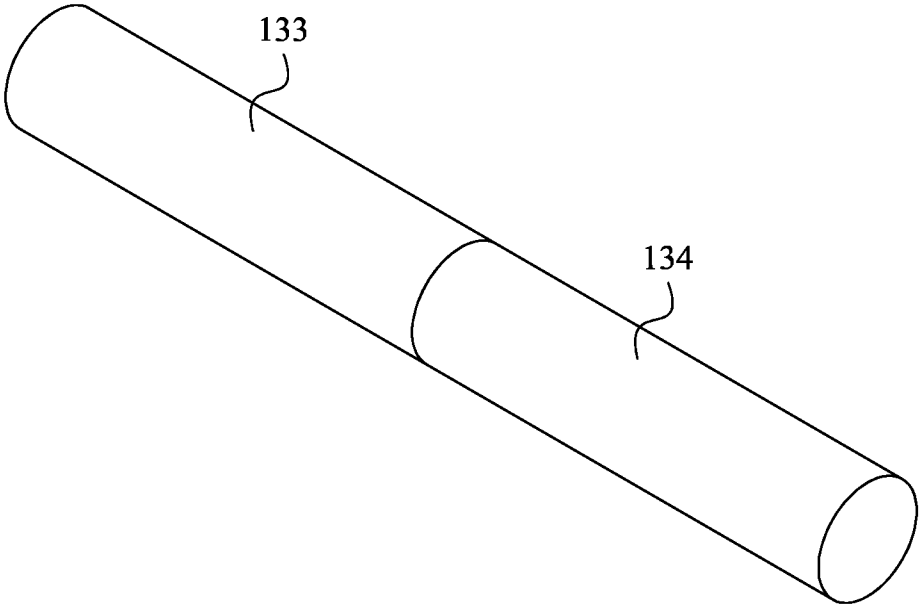
FIG. 13 depicts a perspective view of the filling member of the present invention, wherein the filling member consists of two filling sub-members.

The filling member 130 is configured to be positioned within the internal compartment 113. The filling member 130 may be inserted into the internal compartment 113 of the elongated body 110 via the opening 116. It should also be noted that the filling member 130 can be of any shape, size, material, features, type or kind, orientation, location, quantity, components, and arrangements of components that would allow the present invention to fulfill the objectives and intents of the present invention. In a preferred embodiment, the filling member 130 is a tubular member that is slightly smaller than the elongated body 110 with respect to the inner diameter and the length, such that the filling member 130 can easily fit inside the internal compartment 113 of the elongated body 110. The filling member 130 comprises a first end 131 and a second end 132, corresponding to the first end 111 and the second end 112 of the elongated body 110, respectively. Furthermore, the filling member 130 is preferably made from a material that is flexible, resilient, lightweight, and/or easily manufacturable. For instance, the filling member 130 may be made from compound foam. In one embodiment, the elongated body 110 may comprise a cloth inner lining or a nonabsorbent inner lining to prevent the filling member 130 from becoming wet. Moreover, the filling member 130 may be absorbent or repellent to liquids (e.g., water) according to different design requirements. In a preferred embodiment, the filling member 130 may be composed of a plurality of sub-members. For example, the filling member 130 may preferably consist of two sub-members, i.e., a first filling sub-member 133 and a second filling sub-member 134, preferably of equal length, as illustrated in FIG. 13. In this preferred embodiment, the first filling sub-member 133 and the second filling sub-member 134 may be inserted into the internal compartment 113 one after another, with the first filling sub-member 133 being pushed towards the first end 111 of the elongated body 110 and the second filling sub-member 134 being pushed towards the second end 112 of the elongated body 110. In this way, the first filling sub-member 133 may be positioned adjacent to the first end 111 of the elongated body 110. The second filling sub-member 134 may be positioned adjacent to the second end 112 of the elongated body 110.

The user may assemble the present invention by detaching the flap 117 from the opening 116. The user may then introduce the filling member 130 into the internal compartment 113 via the opening 116. To best fit the filling member 130 inside the inner compartment 113, the user first inserts the first end 131 of the filling member 130 and pushes filling member 130 towards the first end 111 of the elongated body 110. Then, the user may insert the second end 132 of the filling member 130 via the opening 116 and pushes filling member 130 towards the second end 112 of the elongated body 110, until the filling member 130 fully fits inside the internal compartment 113. When fully assembled, the filling member 130 helps maintain the cylindrical shape of elongated body 110. The user may then close the flap 117 and fasten the flap 117 against the opening 116 and onto the elongated body 110. The present invention may be placed near a bathtub or shower for easy access and use.

It is envisioned that the sizes of the components forming the present invention such as the elongated body 110, the pair of end caps 120, and/or the filling member 130 can vary based on design requirements.

Although the disclosure has been explained in relation to its preferred embodiment, it is to be understood that many other possible modifications and variations can be made without departing from the spirit and scope of the disclosure.

What is claimed is:

1. A cleaning apparatus comprising:

an elongated cylindrical body;

a pair of distinct separate end caps;

a filling member;

an internal compartment;

an opening;

a flap;

a fastening mechanism;

the elongated body comprising a first end and a second end;

the pair of end caps comprising a first end cap and a second end cap;

the internal compartment traversing through the elongated body;

the internal compartment being extended from the first end to the second end;

the filling member being positioned within the internal compartment;

the first end cap being terminally connected around the first end;

the second end cap being terminally connected around the second end;

the opening centrally positioned between the first end cap and the second end cap;

the opening traversing into the internal compartment through the elongated body;

the filling member comprising a first filling sub-member and a second filling sub-member;

the first filling sub-member being positioned adjacent to the first end of the elongated body; and the second filling sub-member being positioned adjacent to the second end of the elongated body;

the flap comprising a top end and a bottom end;

the top end of the flap being hingedly connected onto the elongated body;

the flap being centrally aligned over the opening and sized such that the flap can entirely cover the opening; and the bottom end of the flap being mounted to the elongated body through the fastening mechanism.

2. The cleaning apparatus as claimed in claim 1, wherein the elongated body is made from liquid-absorbing material.

3. The cleaning apparatus as claimed in claim 1, wherein a length of the elongated body is equal to a length of the internal compartment.

4. The cleaning apparatus as claimed in claim 1, wherein the opening is a rectangular opening.

5. The cleaning apparatus as claimed in claim 1, further comprising:

the fastening mechanism comprising a first interlocking fastener and a second interlocking fastener;

the first interlocking fastener being connected onto the elongated body;

and the second interlocking fastener being connected onto the flap.

* * * * *